US006772601B1

(12) United States Patent
Davis et al.

(10) Patent No.: US 6,772,601 B1
(45) Date of Patent: Aug. 10, 2004

(54) TEMPERATURE CONTROL SYSTEM FOR A REFRIGERATED COMPARTMENT

(75) Inventors: Kenneth E. Davis, Berwyn, IL (US); Alvin V. Miller, Swisher, IA (US); John P. Myers, Galesburg, IL (US); Joseph H. Ryner, New Windsor, IL (US); Kyle B. VanMeter, Galesburg, IL (US); Robert L. Wetekamp, Cedar Rapids, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/385,636

(22) Filed: Mar. 12, 2003

(51) Int. Cl.[7] ..... F25D 17/08

(52) U.S. Cl. ..... 62/187; 62/408; 62/414; 236/DIG. 12

(58) Field of Search ..... 62/187, 186, 89, 62/179, 180, 404, 407, 408, 413, 414, 419, 441; 236/DIG. 12

(56) References Cited

U.S. PATENT DOCUMENTS

| | | | | |
|---|---|---|---|---|
| 2,240,882 A | | 5/1941 | Brain | |
| 2,346,287 A | | 4/1944 | Borgerd et al. | |
| 2,467,427 A | | 4/1949 | Green | |
| 2,546,363 A | | 3/1951 | Jaeger | |
| 2,866,323 A | | 12/1958 | Candor | |
| 3,107,502 A | | 10/1963 | Herndon, Jr. et al. | |
| 3,126,717 A | | 3/1964 | Schumacher | |
| 3,232,071 A | | 2/1966 | Wallenbrock et al. | |
| 3,759,053 A | * | 9/1973 | Swaneck, Jr. | 62/157 |
| 4,439,998 A | | 4/1984 | Horvay et al. | |
| 4,646,528 A | | 3/1987 | Marcade et al. | |
| 4,732,009 A | | 3/1988 | Frohbieter | |
| 5,201,888 A | | 4/1993 | Beach, Jr. et al. | |
| 5,406,805 A | | 4/1995 | Radermacher et al. | |
| 5,460,009 A | | 10/1995 | Wills et al. | |
| 5,555,736 A | | 9/1996 | Wills et al. | |
| 5,687,580 A | * | 11/1997 | Jeong et al. | 62/186 |
| 5,692,383 A | | 12/1997 | Jeong et al. | |
| 5,715,693 A | | 2/1998 | van der Walt et al. | |
| 5,715,703 A | | 2/1998 | Kopf et al. | |
| 5,732,561 A | | 3/1998 | Kim | |
| 5,778,694 A | | 7/1998 | Jeong | |
| 5,799,496 A | | 9/1998 | Park et al. | |
| 5,799,500 A | | 9/1998 | Kang | |
| 5,943,870 A | * | 8/1999 | Lee | 62/187 |
| 5,996,361 A | | 12/1999 | Bessler et al. | |
| 6,000,232 A | | 12/1999 | Witten-Hannah et al. | |
| 6,038,874 A | | 3/2000 | van der Walt et al. | |
| 6,138,460 A | | 10/2000 | Lee | |
| 6,176,097 B1 | | 1/2001 | Kim | |
| 6,196,011 B1 | | 3/2001 | Bessler | |

FOREIGN PATENT DOCUMENTS

| | | |
|---|---|---|
| JP | 401219468 | 9/1989 |
| JP | 404302976 | 10/1992 |
| JP | 406129749 | 5/1994 |

* cited by examiner

*Primary Examiner*—Harry B. Tanner
(74) *Attorney, Agent, or Firm*—Diederiks & Whitelaw, PLC

(57) ABSTRACT

A refrigerator, having freezer and fresh food compartments, includes a temperature sensor arranged to sense an average temperature in the fresh food compartment, a multi-position damper interposed in an intake duct leading from the freezer compartment, and a fresh food compartment stirring fan. The stirring fan receives a flow of air from each of the intake duct and a plurality of recirculation ducts exposed to different portions of the fresh food compartment. A control system regulates the stirring fan and the opening of the damper based on the sensed temperature in order to minimize temperature stratification within the fresh food compartment, while maintaining an energy efficient and noise reducing operation.

22 Claims, 3 Drawing Sheets

TEMPERATURE CONTROL SYSTEM FOR A REFRIGERATED COMPARTMENT

BACKGROUND OF INVENTION

1. Field of Invention

The present invention pertains to the art of refrigerators and, more particularly, to a temperature control system for efficiently maintaining a substantially uniform temperature within a compartment of a refrigerator.

2. Discussion of Prior Art

In general, refrigerated appliances include a freezer compartment for maintaining foodstuffs at or below freezing, and a fresh food compartment, in fluid communication with the freezer compartment, for maintaining foodstuffs in a temperature zone below ambient temperature but above freezing temperatures. A typical refrigerator includes a refrigeration system including a compressor, a condenser, a condenser fan, an evaporator coil, and evaporator fan.

In operation, temperature sensors are arranged within the refrigerator to measure a temperature within a compartment. When a door associated with either compartment is opened, the temperature within the respective compartment will rise. When the internal temperature of the refrigerator deviates from a pre-selected temperature, the refrigeration system is caused to operate such that the temperature will return to a point below the selected set-point. In order to return the compartment temperature to this point, prior art systems operate at maximum capacity regardless of the degree of the deviation.

Once the desired compartment temperature is achieved, an additional problem arises. The temperature with the compartment begins to stratify, or separate. Warmer air rises to the top of the compartment and, likewise, cooler air settles to the bottom. This can result in substantial harm to food products stored within the appliance. The magnitude of the stratifications has historically been dependent on the location of a thermostat. Prior art systems typically measure the temperature of the compartment at a single measuring point, hence, not until the temperature at that location falls below the set level of the thermostat, is the refrigeration system activated. Once activated, the compressor has to lower the temperature of the compartment until the same measuring point reaches the pre-set level.

One method devised to reduce this stratification problem concerns employing an adjustable damper in a passage between the first and second compartments. This arrangement enables cooler air to pass from the freezer compartment to an upper portion of the fresh food compartment. Unfortunately, the addition of a damper alone simply does not solve the various problems of these known arrangements. To this end, it has also been proposed to incorporate a fan within a housing adjacent to the evaporator to assure a desired cooling air flow to the fresh food compartment. Accordingly, if the temperature of the fresh food compartment rises above the set-point, the damper is operated to allow the passage of forced cooling air from across the evaporator to the fresh food compartment.

Regard less of these known arrangements, there still lacks an efficient control arrangement that avoids both stratification in the fresh food compartment and rather large temperature variations prior to activation of the refrigeration system. Therefore, once, a desired operation temperature has been selected, the refrigeration system strives to maintain a uniform compartment temperature. However, without adequate air circulation within the compartment, the temperature will begin to stratify such that air located in the upper regions of the compartment will be substantially warmer than air in the lower regions. In addition, there is as inherent time delay in adjusting the compartment temperature which further promotes compartment stratification. Accordingly, there exists a need for a temperature control system adapted to maintain a uniform temperature throughout a refrigerated compartment, wherein the system responds rapidly to any temperature fluctuations and presents an improved air flow system designed to avoid thermal stratification.

SUMMARY OF THE INVENTION

The present invention is directed to a refrigerator which is energy efficient, has a reduced noise output, and exhibits minimal thermal stratification. In accordance with the invention, cooling air is drawn from a first or freezer compartment into an intake duct and delivered to a manifold located in a second or fresh food compartment of the refrigerator. A multi-position damper is arranged in the intake duct for regulating the flow of the cooling air. The manifold also preferably receives a flow of recirculating air through additional ducting exposed at varying height portions in the fresh food compartment. A stirring fan is arranged in fluid communication with the manifold to disperse the combined air flow through the fresh food compartment. Most preferably, the stirring fan is continuously operated.

In order to establish effective temperature regulation, the refrigerator includes a control system which is responsive to an arrangement for sensing an average temperature in the fresh food compartment. In accordance with the most preferred embodiment of the invention, the fresh food compartment is provided with an elongated metal shelf rail which extends vertically from an upper portion to a lower portion of the fresh food compartment. With this configuration, the shelf rail will reflect an average fresh food compartment temperature which is sensed by a temperature sensor provided on the shelf rail.

With this overall system, the temperature in the fresh food compartment can be effectively and efficiently maintained at a desired operating temperature, while essentially avoiding thermal stratification in the compartment. In any event, additional objects, features and advantages of the invention will become more readily apparent from the following detailed description of a preferred embodiment of the invention, when taken in conjunction with the drawings wherein like reference numerals refer to corresponding parts in the several views.

DETAILED DESCRIPTION OF THE INVENTION

Figure 1:
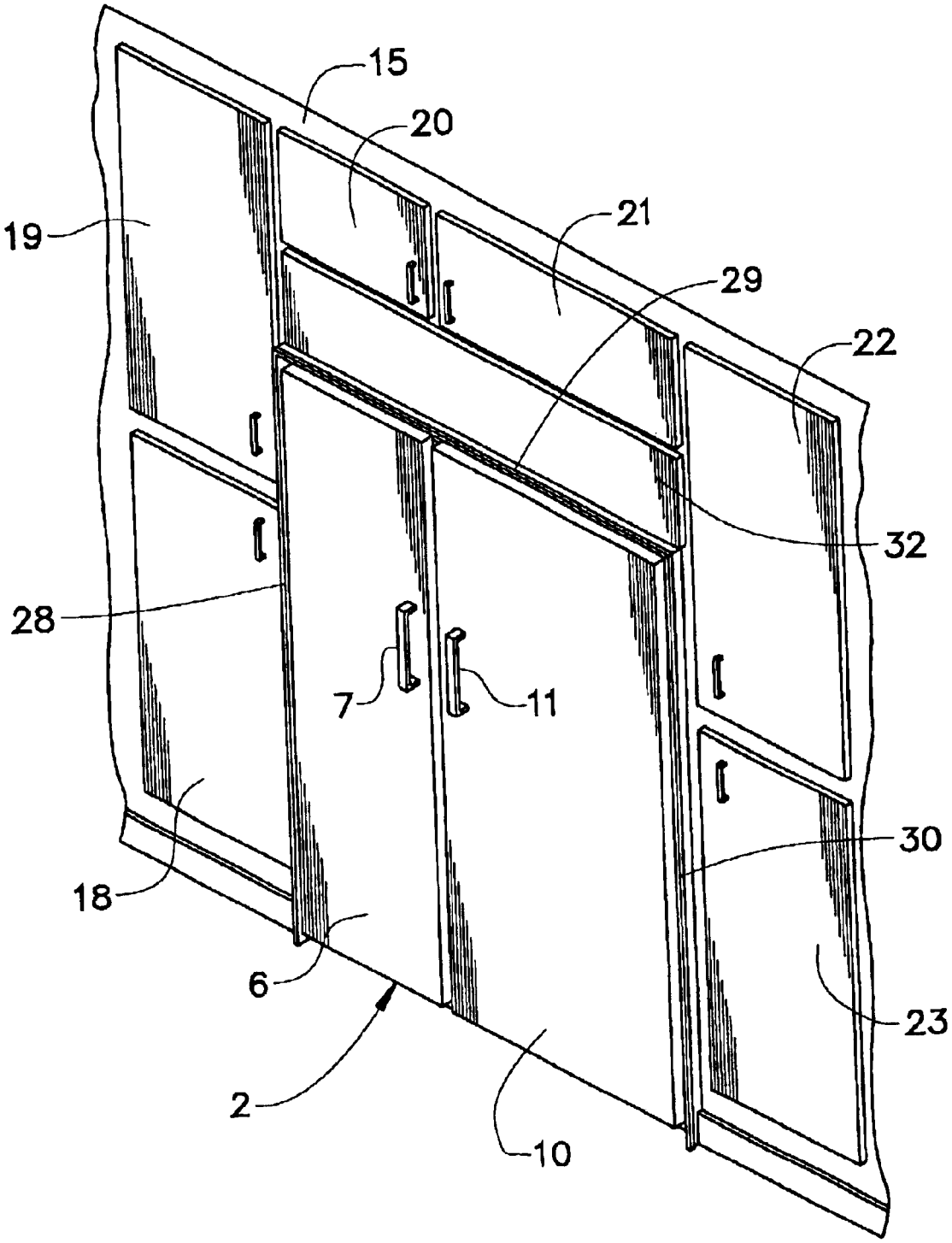
FIG. 1 is a front view of a refrigerator employing the temperature control system of the invention.

With initial reference to FIG. 1, a refrigerator constructed in accordance with the present invention is generally shown at 2. Refrigerator 2 is shown to include a freezer door 6 having an associated handle 7 and a fresh food door 10 having an associated handle 11. In the embodiment shown, refrigerator 2 is of the recessed type such that, essentially, only freezer and fresh food doors 6 and 10 project forward of a wall 15. The remainder of refrigerator 2 is recessed within wall 15 in a manner similar to a plurality of surrounding cabinets generally indicated at 18–23. Refrigerator 2 also includes a plurality of peripheral trim pieces 28–30 to blend refrigerator 2 with cabinets 18–23. One preferred embodiment employs trim pieces 28–30 as set forth in U.S. Patent Application entitled "Fastening System for Appliance Cabinet Assembly" filed on even date herewith and which is incorporated herein by reference. Finally, as will be described more fully below, refrigerator 2 is preferably designed with main components of a refrigeration system positioned behind an access panel 32 arranged directly above trim piece 29.

Figure 2:
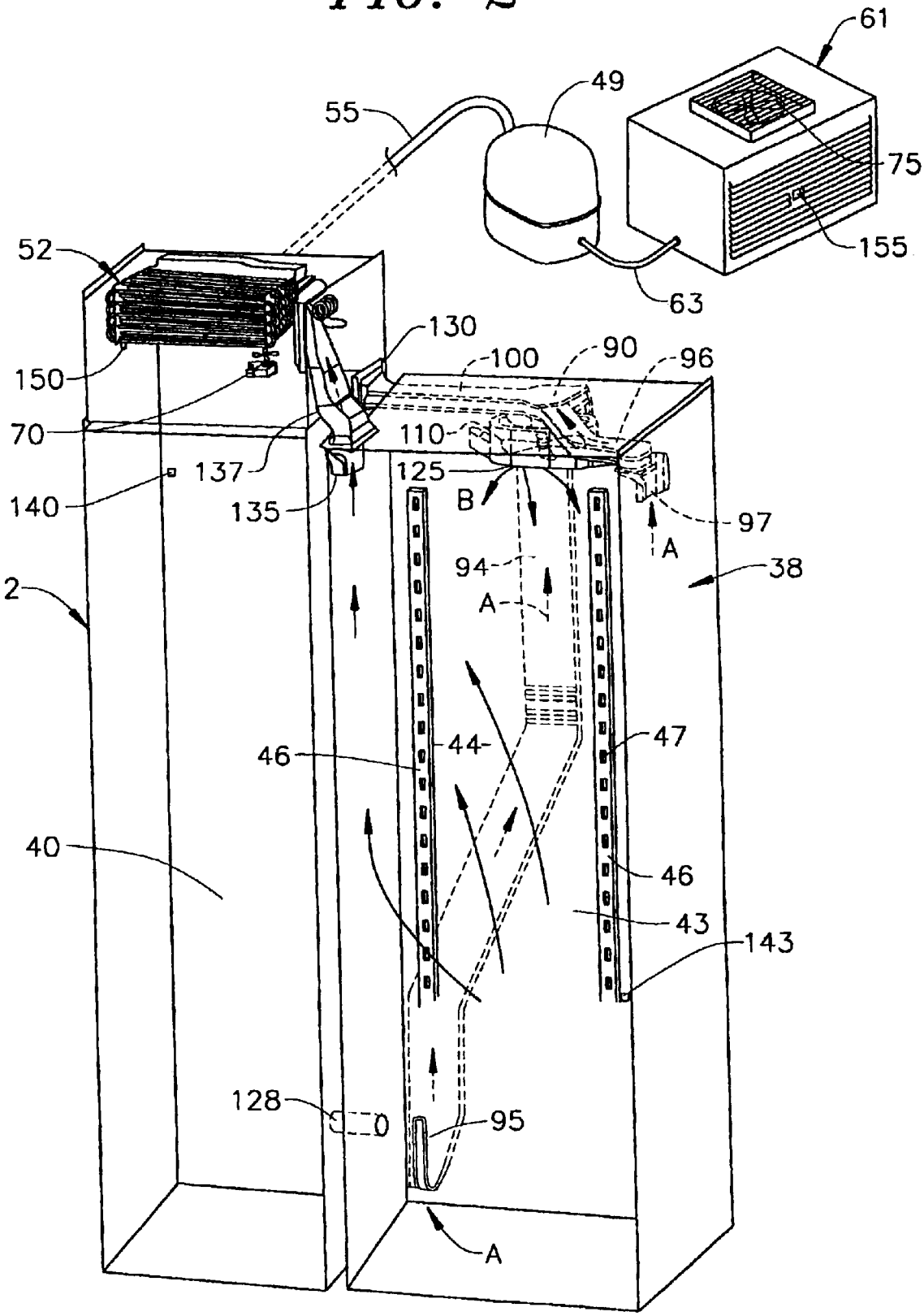
FIG. 2 is a partially exploded view showing various components of the temperature control system of the invention.

As shown in FIG. 2, refrigerator 2 includes a cabinet shell 38 defining a freezer compartment 40 and a fresh food compartment 43. For details of the overall construction of cabinet shell 38, reference is again made to U.S. Patent Application entitled "Fastening System for Appliance Cabinet Assembly" filed on even date herewith and incorporated by reference. Shown arranged on a rear wall 44 of fresh food compartment 43 are a plurality of elongated metal shelf rails 46. Each shelf rail 46 is provided with a plurality of shelf support points, preferably in the form of slots 47, adapted to accommodate a plurality of vertically adjustable, cantilevered shelves (not shown) in a manner known in the art. Since the manner in which such shelves can vary and is not considered part of the present invention, the shelves have not been depicted for the sake of clarity of the drawings and will not be discussed further here. However, for purposes which will be set forth further below, it should be noted that each of rails 46 preferably extends from an upper portion, through a central portion, and down into a lower portion (each not separately labeled) of fresh food compartment 43.

Preferably mounted behind access panel 32 are components of the refrigeration system employed for refrigerator 2. More specifically, the refrigeration system includes a variable speed compressor 49 which is operatively connected to both an evaporator 52 through conduit 55, and a condenser 61 through conduit 63. Arranged adjacent to evaporator 52 is an evaporator fan 70 adapted to provide an airflow to evaporator 52. Similarly, arranged adjacent to condenser 61 is a condenser fan 75 adapted to provide an airflow across condenser 61. In accordance with the invention, variable speed compressor 49 is operated at a respective optimum speed based upon sensed cooling demand within refrigerator 2 as will be detailed fully below.

In addition to the aforementioned components, mounted to an upper portion of fresh food compartment 43 is an air manifold 90 for use in directing a cooling airflow through fresh food compartment 43 of refrigerator 2. More specifically, a first recirculation duct 94 having an inlet 95 exposed in a lower portion of fresh food compartment 43, a second recirculation duct 96 having an inlet 97 exposed at an upper portion of fresh food compartment 43, and an intake duct 100 establishing an air path for a flow of fresh cooling air from freezer compartment 40 into manifold 90. Arranged in fluid communication with air manifold 90 is a fresh food stirring fan 110. Stirring fan 110 is adapted to receive a combined flow of air from recirculation ducts 94 and 95, as well as intake duct 100, and to disperse the combined flow of air into the fresh food compartment 43. In this way, very cold air from intake duct 100 is mixed with recirculated air from ducts 94 and 95 to create a slightly cooler air mixture for discharge into compartment 43 in order to minimize temperature stratification.

In accordance with the most preferred form of the invention, stirring fan 110 is operated continuously. With this arrangement, stirring fan 110 draws in a flow of air, which is generally indicated by arrows A, through inlets 95 and 97 of ducts 94 and 96, and intake duct 100, while subsequently exhausting the combined flow of cooling air, represented by arrow B, through outlet 125. Most preferably, outlet 125 directs the air flow in various directions in order to generate a desired flow pattern based on the particular configuration of fresh food compartment 43 and any additional structure provided therein. The exact positioning of inlets 95 and 97 also depend on the particular structure provided. In one preferred embodiment, inlet 95 of duct 94 is located at a point behind at least one food storage bin (not shown) arranged in a bottom portion of fresh food compartment 43. The air flow past the storage bin is provided to aid in maintaining freshness levels of food contained therein. For this purpose, an additional passage leading from freezer compartment 40 into fresh food compartment 43 can be provided as generally indicated at 128. While not part of the present invention, the details of the storage bin are described in U.S. Pat. No. 6,170,276 which is hereby incorporated by reference.

In order to regulate the amount of cooling air drawn in from freezer compartment 40, a multi-position damper 130 is provided either at an entrance to or within intake duct 100. As will be discussed more fully below, when the cooling demand within fresh food compartment 43 rises, multi-position damper 130 opens to allow cooling air to flow from freezer compartment 40 to fresh food compartment 43 and, more specifically, into intake duct 100 to manifold 90 and stirring fan 110. A flow of air to be further cooled at evaporator 52 is lead into an intake 135 of a return duct 137. In the embodiment shown, return duct 137 is preferably located in the upper portion of fresh food compartment 43.

In accordance with the invention, this overall refrigeration system synergistically operates to both maintain the temperature within fresh food compartment 43 at a substantially uniform temperature preferably established by an operator and minimizes stratification of the temperature in fresh food compartment 43. In order to determine the cooling demand within freezer compartment 40 and fresh food compartment 43, a plurality of temperature sensors are arranged throughout refrigerator 2. Specifically, a freezer temperature sensor 140 is located in freezer compartment 40, a fresh food compartment temperature sensor 143 is mounted on shelf rail 46, an evaporator coil temperature sensor 150 is mounted adjacent to evaporator 52, and a sensor 155, which is preferably arranged in a position directly adjacent to an intake associated with condenser 61, is provided to measure the ambient air temperature.

As indicated above, shelf rails 46 are preferably made of metal, thereby being a good conductor. As will become more fully evident below, other high conductive materials could be employed. In addition, shelf rails 46 preferably extend a substantial percentage of the overall height of fresh food compartment 43. In this manner, the temperature sensed by sensor 143 is representative of the average temperature within fresh food compartment 43. Certainly, an average temperature reading could be obtained in various ways, such as by averaging various temperature readings received from sensors located in different locations throughout fresh food compartment 43. However, by configuring and locating sensor 143 in this manner, an average temperature reading can be obtained and the need for further, costly temperature sensors is avoided. Actually, although not shown, freezer temperature sensor 140 is also preferably provided at a corresponding freezer shelf rail for similar purposes.

Figure 3:
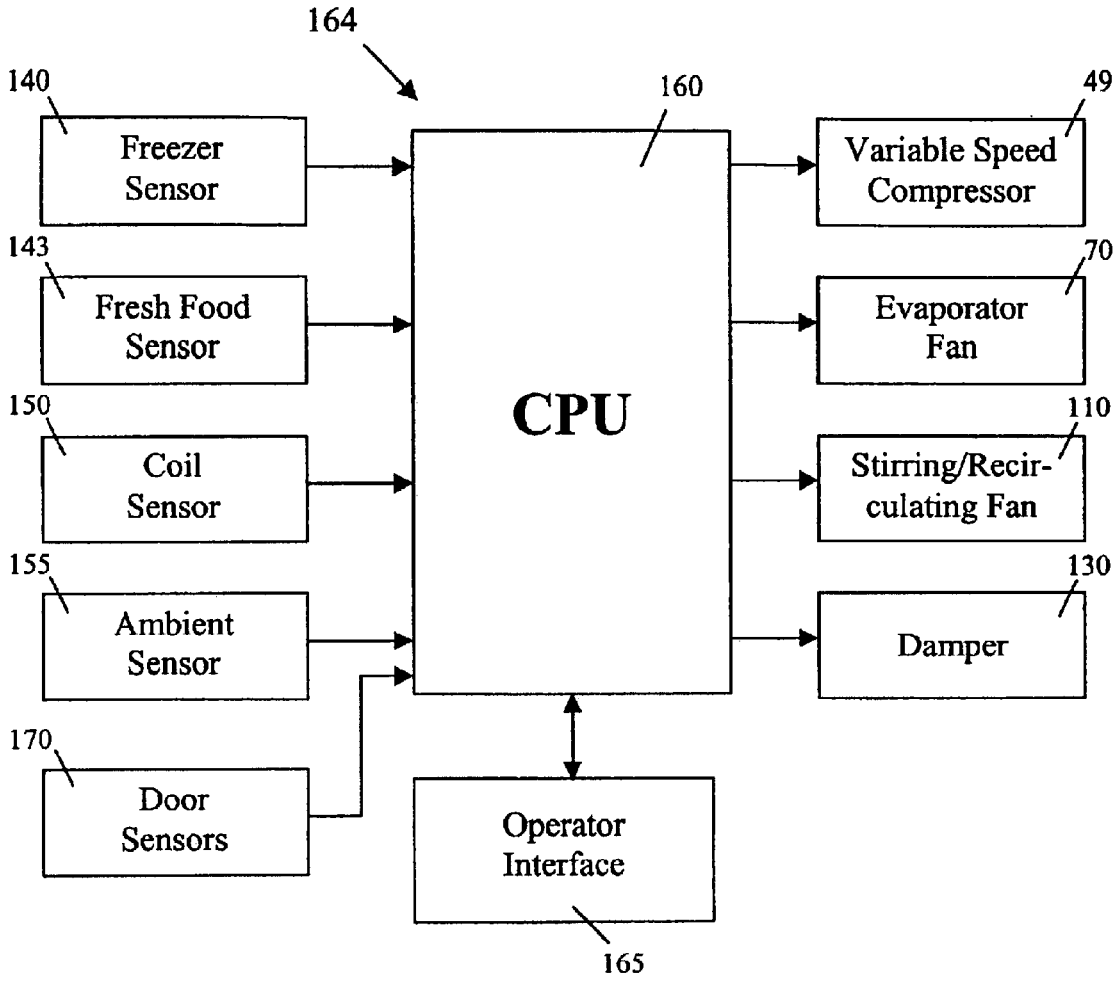
FIG. 3 is a block diagram depicting the control system of the present invention.

As shown in FIG. 3, a controller or CPU 160, forming part of an overall control system 164 of refrigerator 2, is adapted to receive inputs from each of the plurality of temperature sensors 140, 143, 150 and 155, as well as operator inputs from an interface 165. In addition to operating stirring fan 110, CPU 160 functions to regulate the operational speed of variable speed compressor 49, as well as the operation of evaporator fan 70 and the position of damper 130, in order to maintain a desired temperature throughout fresh food compartment 43. At this point, it should be noted that interface 165 can take various forms in accordance with the invention. For instance, interface 165 could simply constitute a unit for setting a desired operating temperature for freezer compartment 40 and/or fresh food compartment 43, such as through the use of push buttons or a slide switch. In one preferred form of the invention, although not shown in FIG. 1, interface 165 is constituted by an electronic control panel mounted on either door 6 or 10 to enter desired operating temperatures and a digital display to show temperature set points and/or actual compartment temperatures. The display could incorporate a consumer operated switch to change the displays from ° F. to ° C. and vise versa, various alarm indications, such as power interruption and door ajar indicators, service condition signals and, in models incorporating water filters, a filter change reminder. In any event, it is simply important to note that various types of interfaces could be employed in accordance with the invention.

In general, temperature fluctuations within refrigerator 2 can cover a broad spectrum. During a typical day, the doors 6 and 10 of refrigerator 2 can be opened several times and for varying periods of time as signaled by door sensors 170. Each time a door 6, 10 is opened, cold air escapes from a respective compartment 40, 43 and the temperature within the compartment 40, 43 is caused to rise. A certain temperature rise will necessitate the activation of the refrigeration system in order to compensate for the cooling loss. However, each door opening does not release the same amount of cold air, and therefore a uniform level of temperature compensation will not be needed. Accordingly, control system 164 determines the required cooling load and maintains the temperature with first compartment 43 in a predetermined, small temperature range or confined temperature band through the operation of stirring fan 110 and by regulating each of the compressor 49 and evaporator fan 70, along with establishing an appropriate position for damper 130. That is, CPU 160 regulates the component operation and establishes the proper damper position interdependently, as will be detailed below, thereby obtaining synergistic results for the overall temperature control system. In fact, it has been found that fresh food compartment 43 can be reliably maintained within as small a temperature range as 1° F. (approximately 0.56° C.) from a desired set point temperature in accordance with the invention.

As indicated above, temperature sensor 143 monitors the average temperature at shelf rail 146 and sends representative signals to CPU 160 at periodic intervals to reflect an average temperature within fresh food compartment 43. CPU 160 preferably takes a derivative of the sensed temperatures to develop a temperature gradient or slope representative of a rate of change of the temperature within fresh food compartment 43. Based upon the steepness of the slope, CPU 160 regulates the operational speed of compressor 49. In accordance with the most preferred form of the invention, this derivative is taken approximately every 30 seconds.

The position of damper 130 is established based on the temperature in fresh food compartment 43 as measured by sensor 143. Damper 130 will be maintained in an open position until temperature sensor 143 sends a signal to CPU 160 indicating the average temperature within fresh food compartment 43 has returned to the desired level, but can be slowly closed when the temperature in fresh food compartment 43 is heading toward the correct, set-point direction.

Of course, there will be requirements for additional cooling to be performed within freezer compartment 40 in order to enable lower temperature air to flow through intake duct 100. In these times, CPU 160 will operate compressor 49 and evaporator fan 70 at optimum operational speeds. Specifically, CPU 160 regulates the operation of variable speed compressor 49 based on the temperature in freezer compartment 40 as relayed by sensor 140, as well as the operator setting for a desired operating temperature for fresh food compartment 43 as received from interface 165. Based upon the magnitude and direction of the temperature deviation, compressor 49 will be operated at a speed, determined by the CPU 160 to minimize energy usage and to rapidly return the temperature within freezer compartment 40 to within a pre-selected range or confined band based on the operator setting. CPU 160 further controls evaporator fan 70 based on at least temperatures sensed by evaporator temperature sensor 150 arranged at the coils of evaporator 52, the operation of compressor 49 and signals from door sensors 170. In general, evaporator fan 70 operates at a first speed when compressor 49 is on and at a lower speed when either of freezer or fresh food doors 6 and 10 are open as signaled by sensor 170, while being off if the temperature signaled by evaporator temperature sensor 150 is above a predetermined limit, e.g. 23° F. Further details of the overall operation of the refrigeration system employed in refrigerator 2 are presented in U.S. Patent Application entitled "Variable Speed Refrigeration System" filed on even date herewith and incorporated herein by reference.

Based on the above, it should be readily apparent that the invention provides for a temperature control system of the type which enables refrigerator compartments to be maintained at desired temperatures with little variations, maximizes and makes efficient use of energy, and addresses reducing the amount of noise emitted to the surroundings. Even though the various components are controlled individually through CPU 160, CPU 160 operates them collectively and in an interdependent manner such that synergistic results are obtained. Therefore, refrigerator 2 constructed in accordance with the present invention reduces the amount of energy consumed as compared to similar appliances. A quick opening of a compartment door will not require the refrigeration system to operate at full speed to compensate for the temperature loss., Instead, any temperature variations are continuously addressed by the operation of the various components such that even slight temperature deviations are appropriately compensated in a substantially proactive fashion. In this manner, and with the continual operation of the stirring fan, as well as the overall ducting arrangement employed, temperature stratification within the fresh food compartment is substantially eliminated, and a uniform temperature can be maintained throughout the compartment. In any event, although described with reference to a preferred embodiment, it should be understood that various changes and/or modifications can be made to the invention without departing from the spirit thereof. Instead, the invention is only intended to be limited by the scope of the following claims.

We claim:

1. A refrigerator comprising:

a cabinet shell including a first compartment and a second compartment;

a door provided to selectively seal an access opening for the first compartment;

an elongated shelf rail arranged in the first compartment, said shelf rail being adapted to receive a shelf for supporting food articles;

a temperature sensor mounted to the shelf rail to sense a temperature within the first compartment and to output a signal representative of an average temperature in the first compartment;

an intake duct establishing an air path for a flow of cooling air from the second compartment to the first compartment;

an air manifold mounted in the first compartment and in fluid communication with the intake duct wherein the air manifold is adapted to receive the flow of cooling air from the second compartment;

a damper arranged in the intake duct, said damper being movable between an open position, wherein cooling air is caused to flow from the second compartment to the first compartment, and a closed position;

a stirring fan arranged in fluid communication with the air manifold; and a control system, responsive to the average temperature in the first compartment as signaled by the temperature sensor, for maintaining the temperature within the first compartment in a confined temperature range by at least operating the stirring fan and establishing a position for the damper.

2. The refrigerator according to claim 1, further comprising: a first recirculation duct having an inlet exposed in the first compartment and an outlet leading to the manifold.

3. The refrigerator according to claim 2, wherein the first compartment includes upper, lower and central, vertically spaced portions, and wherein the inlet of said first recirculation duct is arranged in the lower portion of the first compartment.

4. The refrigerator according to claim 2, further comprising: a second recirculation duct having an inlet exposed in the first compartment and an outlet leading to the manifold.

5. The refrigerator according to claim 4, wherein the first compartment includes upper, lower and central, vertically spaced portions, the inlet of said first recirculation duct being arranged in the lower portion of the first compartment, and the inlet of the second recirculation duct being arranged in the upper portion of the first compartment.

6. The refrigerator according to claim 5, further comprising: a return duct leading from the first compartment to the second compartment.

7. The refrigerator according to claim 6, wherein the return duct is located in the upper portion of the first compartment.

8. The refrigerator according to claim 1, wherein the first compartment includes upper, lower and central, vertically spaced portions, and wherein the shelf rail extends into each of the upper, lower and central portions.

9. The refrigerator according to claim 1, wherein the control system continuously operates the stirring fan.

10. The refrigerator according to claim 1, wherein the control system includes means for determining a rate of change of the temperature in the first compartment.

11. A refrigerator comprising:

a cabinet shell including a first compartment in fluid communication with a second compartment, said first compartment including upper, lower and central, vertically spaced portions;

a door provided to selectively seal an access opening for the first compartment;

an intake duct establishing an air path for a flow of cooling air from the second compartment to the first compartment;

an air manifold mounted in the first compartment and in fluid communication with the intake duct wherein the air manifold is adapted to receive the flow of cooling air from the second compartment;

a first recirculation duct having an inlet exposed to the lower portion of the first compartment and an outlet leading to the manifold;

a second recirculation duct having an inlet exposed to the upper portion of the first compartment and an outlet leading to the manifold;

a stirring fan arranged in fluid communication with the air manifold, said stirring fan being adapted to receive a combined flow of air from the intake duct, the first recirculation duct, and the second recirculation duct, and to disperse the combined flow of air into the first compartment;

a damper arranged in fluid communication with the intake duct, between the second compartment and the manifold, said damper being movable between an open position, wherein cooling air is caused to flow from the second compartment to the first compartment, and a closed position; and a control system for maintaining the temperature within the first compartment in a predetermined temperature range by operating the stirring fan and establishing a position for the damper.

12. The refrigerator according to claim 11, farther comprising: a return duct leading from the first compartment to the second compartment.

13. The refrigerator according to claim 12, wherein the return duct is located in the upper portion of the first compartment.

14. The refrigerator according to claim 11, wherein the control system continuously operates the stirring fan.

15. The refrigerator according to claim 11, wherein the control system includes means for determining a rate of change of the temperature in the first compartment.

16. The refrigerator according to claim 11, further comprising:

an elongated, metallic shelf rail arranged in the first compartment, said shelf rail being adapted to receive a shelf for supporting food articles; and a temperature sensor mounted to the shelf rail to sense a temperature within the first compartment and to output a signal representative of an average temperature in the first compartment, said control system regulating the stirring fan and the position for the damper based on at least the average temperature in the first compartment as signaled by the temperature sensor.

17. A method of maintaining a substantially uniform temperature within a first compartment of a refrigerator which is in fluid communication with a second compartment of the refrigerator comprising:

sensing a temperature which is representative of an average temperature within the first compartment;

opening a damper to create an air flow path between from the second compartment to the first compartment based on the sensed temperature;

operating an air stirring fan within the first compartment; and maintaining the temperature in the first compartment within a confined temperature band about an operator selected operating temperature.

18. The method of claim 17, further comprising:

determining a rate of change of the temperature; and regulating a refrigeration system of the refrigerator based on the rate of change of the temperature.

19. The method of claim 17, further comprising: operating said stirring fan continuously.

20. The method of claim 17, further comprising: sensing the temperature through a sensor placed on an elongated, metallic shelf rail mounted in the first compartment.

21. The method of claim 17, further comprising: directing a flow of air to the stirring fan from an intake duct leading from the second compartment, and multiple air recirculation ducts of the first compartment.

22. The method of claim 17, further comprising: maintaining the temperature in the first compartment within approximately 1° F. (about 0.56° C.) of the operator selected operating temperature.

* * * * *